US005713682A

United States Patent [19]

Clark et al.

[11] Patent Number: 5,713,682

[45] Date of Patent: Feb. 3, 1998

[54] PAPER HANDLING DEVICE

[75] Inventors: Dennis Gary Clark, Sacramento, Calif.; Steven Charles Black; Duane Christensen, both of Hastings, Minn.; Michael Barry Lasky, Edina, Minn.

[73] Assignee: Smead Manufacturing Company, Hastings, Minn.

[21] Appl. No.: 649,579

[22] Filed: May 17, 1996

[51] Int. Cl.[6] ..... B42F 03/00

[52] U.S. Cl. ..... 402/7; 402/8; 402/19; 402/80 R; 402/24; 269/47; 269/239; 294/99.2

[58] Field of Search ..... 402/7, 8, 19, 80 R, 402/80 P, 20, 24, 4, 80 L; 281/46; 294/47, 52, 239; 606/210, 211, 207; 600/206; D7/686; D28/55; D24/143; D8/14, 71

[56] References Cited

U.S. PATENT DOCUMENTS

| | | | |
|---|---|---|---|
| 234,855 | 11/1880 | Daniels . | |
| 806,861 | 12/1905 | Wolf | 281/46 |
| 808,936 | 1/1906 | Lintz | 294/99.2 |
| 1,976,623 | 10/1934 | Monroe et al. | 294/99.2 |
| 4,427,315 | 1/1984 | Raisch | 402/80 |
| 4,519,504 | 5/1985 | Nausedas | 206/554 |
| 4,632,586 | 12/1986 | Erickson | 402/7 |
| 4,717,190 | 1/1988 | Witherspoon | 294/99.2 |
| 4,869,613 | 9/1989 | Corey | 402/7 |
| 5,028,160 | 7/1991 | Callander | 402/7 |

FOREIGN PATENT DOCUMENTS

| | | |
|---|---|---|
| 2498527 | 1/1982 | France . |
| 2035215 | 6/1980 | United Kingdom . |

OTHER PUBLICATIONS

"The Surgical Armamentarium"—catalog of hospital supply instruments, p. 478, items A and H, Dec. 1980.

*Primary Examiner*—Andrea L. Pitts
*Assistant Examiner*—Gregory Andoll
*Attorney, Agent, or Firm*—Merchant, Gould, Smith, Edell, Welter & Schmidt, P.A.

[57] ABSTRACT

A paper handling device comprises a flexible, substantially U-shaped handle portion having first and second side members, the first and second side members terminating at first and second ends respectively; first and second arms are respectively disposed at the first and second ends and each directed substantially away from the handle portion; first and second tines depend transversely from the first and second arms respectively, the first and second tines extending in a generally parallel relation and normally spaced apart from each other by a distance greater than the spacing between pre-punched holes in the paper. Compressing the handle portion reduces the distance between the tines so as to allow the tines to be inserted into the respective holes in the paper.

22 Claims, 7 Drawing Sheets

PAPER HANDLING DEVICE

BACKGROUND OF THE INVENTION

1. Field of the Invention.

This invention relates in general to a device for handling papers and, in particular, to a device for handling a stack of pre-punched papers while maintaining alignment of the pre-punched holes.

2. Description of Related Art.

Sheets of paper having pre-punched holes are often bound together using a fastener having a pair of flat legs which are folded upwards to receive the paper, are folded flat, and then fastened down so as to hold the paper sheets in place. Such fasteners, typically found in a file or a folder, may be made from a thin metal strip, such as the metal fasteners manufactured by Acco International of Wheeling, Ill. and sold under the trademark ACCO Fasteners. Similar fasteners made from thin flexible plastic are also in common use.

Paper fastening systems such as the one described above are useful for holding a stack of papers in a file or a folder, but problems may occur when some of the papers have to be removed from the fastener, for example when accessing a paper in the stack for photocopying. Typically, the sheets of paper lying above the paper to be photocopied are removed from the stack of papers and are then replaced after the desired paper has been photocopied. When removing papers from the stack, it is usually difficult to maintain alignment of the pre-punched holes in each sheet of paper. Consequently, replacing the sheets on the stack can be time consuming and tedious, requiring the holes of each paper sheet, or a small group of paper sheets, to be aligned correctly in order to achieve registration between the pre-punched holes and the legs of the fastener. The problem of maintaining alignment of the paper sheets removed from the stack grows with an increasing number of papers stored in the stack.

An attempt to overcome the problem of having to re-align a number of sheets of paper when removed from a fastener is disclosed in U.S. Pat. No. 5,028,160. This patent discusses a U-shaped tool, having a pair of fingers which are each adapted with flat surfaces terminating in slots for receiving the legs of a fastener. After connecting the legs of the fastener to the fingers of tool, the papers to be removed from the fastener are slid along the legs of the fastener and onto the fingers of the tool. The tool is then removed, maintaining alignment of the papers removed from the stack. However, the U-shaped tool suffers from several drawbacks. A first drawback is that the legs of the fastener have to be mated to the fingers of the tool by engaging the ends of the metal legs with slots in the fingers of the tool, requiring dexterous manipulation on behalf of the user. A second drawback is that the tool is not provided with means for keeping the papers on the tool, and so it can prove difficult to prevent the papers from slipping off the fingers. A third drawback is that, since the tool is maintained in a perpendicular alignment with the paper stack in order to mate with the legs of the fastener, the tool is usually held in a vertical orientation in use. This is an awkward orientation in which to hold the tool, making it uncomfortable to use.

There is therefore a need for a new paper handling device for use in aligning a number of paper sheets prior to placing them on to a fastener. The new paper handling device should be comfortable for the user to hold, and should not require holding in an awkward orientation. In addition, the new tool should provide means for holding sheets of paper on the tool and should avoid the need to engage the legs of a fastener with the tool.

SUMMARY OF THE INVENTION

To minimize the limitations in the prior art described above, and to minimize other limitations that will become apparent upon reading and understanding the present specification, the present invention discloses a new tool for holding loose papers having pre-punched holes. An object of the present invention is to provide an easily held, paper handling device which requires no alignment with a paper fastener and which provides means for holding papers in place on the tool in order to reduce the chance of papers falling off the tool and thus loosing alignment of the pre-punched holes.

The paper handling device comprises a flexible, substantially U-shaped handle portion having first and second side members, the first and second side members terminating at first and second ends respectively; first and second arms extending respectively from the first and second ends, first and second tines transversely depending from the first and second arms respectively, the first and second tines extending in a generally parallel relation and normally spaced apart from each other by a distance greater than the spacing between the pre-punched holes in the paper. Compressing the handle portion reduces the distance between the tines so as to allow the tines to be inserted into the respective holes in the paper.

BRIEF DESCRIPTION OF THE DRAWINGS

Referring now to the drawings in which like reference numbers represent corresponding parts throughout.

DETAILED DESCRIPTION OF THE PREFERRED EMBODIMENT

In the following description of the preferred embodiment, reference is made to the accompanying drawings which form a part hereof, and in which is shown by way of illustration a specific embodiment in which the invention may be practiced. It is to be understood that other embodiments may be utilized and structural changes may be made without departing from the scope of the present invention.

Figure 1:
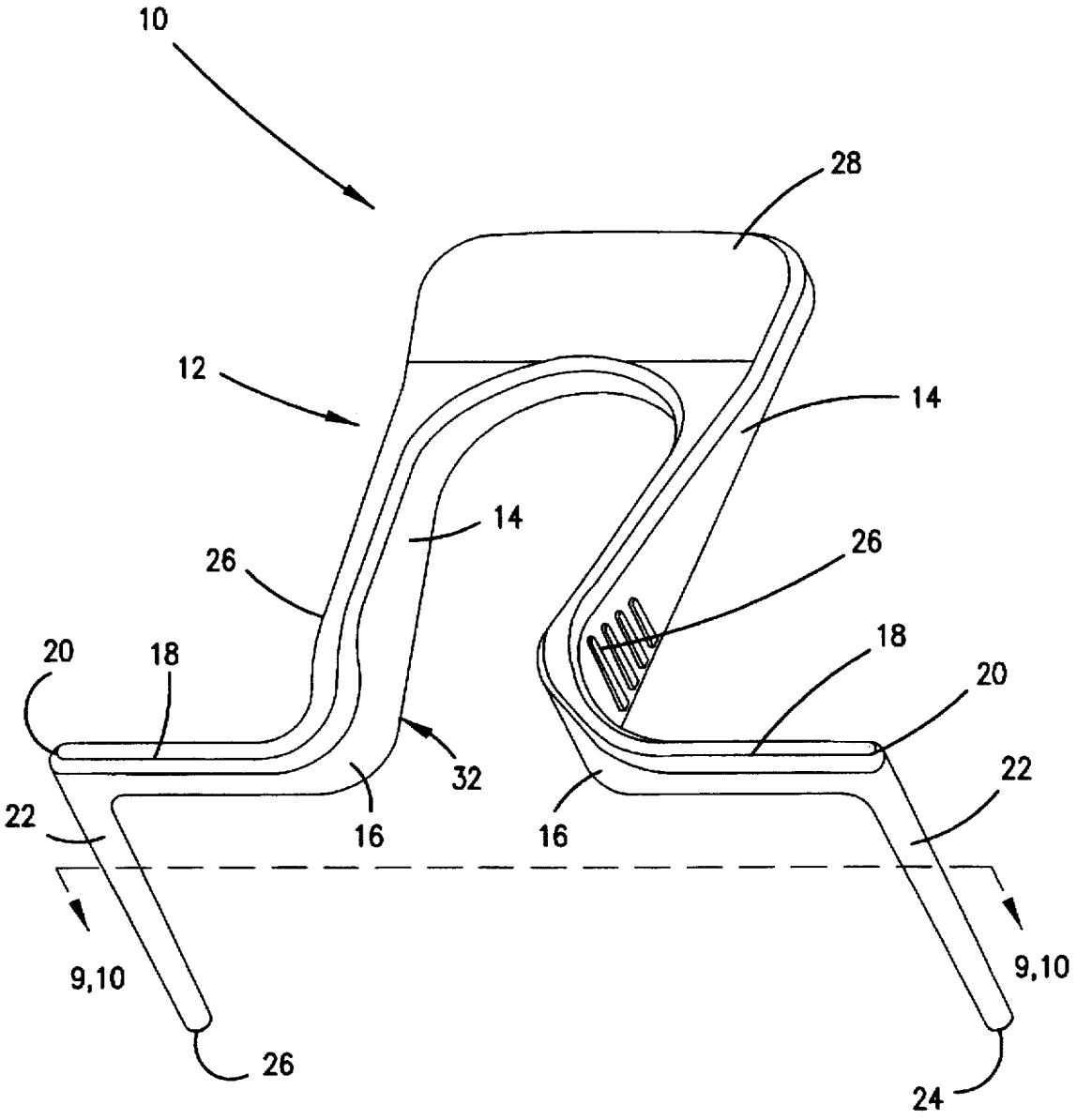
FIG. 1 is a perspective view of the paper handler according to the invention.

FIG. 1 illustrates a first embodiment of the paper handling device according to the present invention. The device, viewed as element 10, has a generally U-shaped handle portion 12, having two side members 14, terminating at member ends 16, respectively. The width of the handle portion 12, i.e. the distance separating the two side members 14, preferably ranges from 2 cm to 4 cm so that the handle portion 12 may be readily gripped between a human forefinger and thumb. The exertion of squeezing pressure by a hand on the handle portion 12 results in elastic compression of the handle portion 12, and the separation between member ends 16 is reduced from its uncompressed value. When the squeezing pressure is released, the distance separating the member ends 16 returns to its uncompressed value.

Two arms 18 extend from the member ends 16, directed respectively away from the handle portion 12. The two arms 18 preferably extend in opposite directions from each other. In this embodiment, the two arms 18 extend from the handle portion 12 at an angle close to 90° from their respective side members 14. Each arm 18 terminates at an arm end 20.

A tine 22 depends from each arm end 20, in a direction which is not parallel to the handle portion 12. In the first embodiment, the tines 22 extend transversely from the arms 18, in a direction close to 90° from the direction of each arm 18. The tines 22 extend substantially parallel to each other.

The tines 22 may be normally spaced apart by 2.75 inches, the standard separation for a pair of pre-punched holes in paper sheets, in which case the tines 22 may be inserted into the pre-punched holes without squeezing the handle portion 12. The handle portion 12 may then be either squeezed or separated in order to hold the paper sheets on the device 10.

Alternatively, the tines 22 may be normally spaced apart by approximately 3 inches, a separation greater than the standard separation of pre-punched holes in paper sheets, namely 2.75 inches. In order to insert the tines 22 into the pre-punched holes of a paper sheet, the handle portion 12 is squeezed so that the separation of the tines 22 matches the separation of the pre-punched holes. Once the tines 22 are inserted into the holes in the paper sheet, or sheets, and the handle portion 12 released, the tines 22 separate under the restoration force of the handle portion 12. The separating movement of the tines 22 is limited by the pre-punched holes and so the tines 22 exert a force on the paper sheets. Consequently, the paper sheets are not free to move along the tines 22 and are, therefore, prevented from falling off the device 10.

Additinally, the tines may 22 also be spaced apart by a separation less than 2.75 inches, in which case the handle portion 12 is pulled apart in order to insert the tines 22 into the pre-punched holes. Once inserted, the tines 22 exert an inward force on the paper, pushing the pre-punched holes together.

Figure 2:
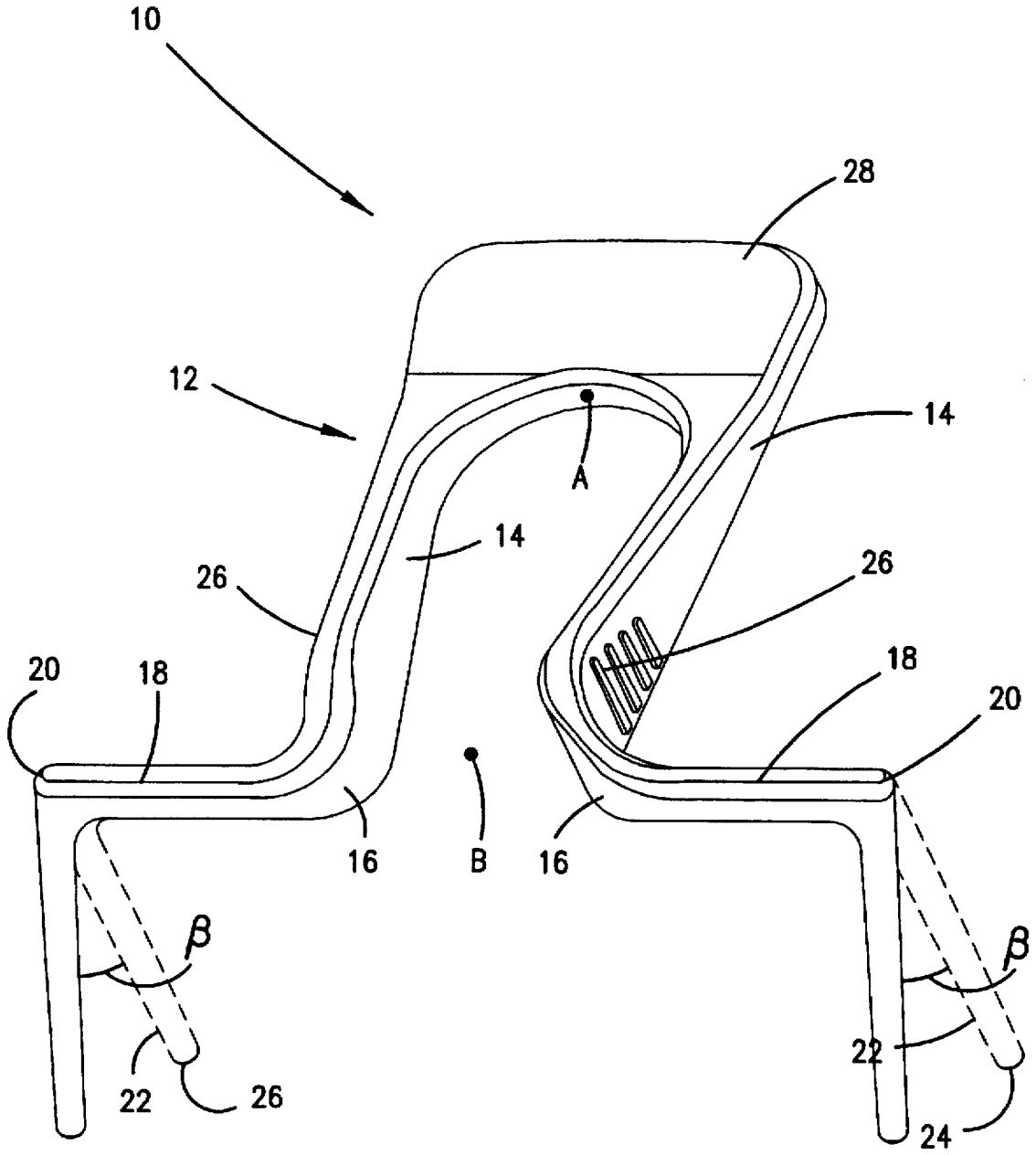
FIG. 2 is a perspective view of a second embodiment of the paper handling device.

The tines 22 may be oriented to extend in a direction which is not transverse to the handle portion 12. FIG. 2 illustrates a second embodiment of the invention where the tines extend at an angle β (beta) relative to the perpendicular arrangement of the first embodiment, the tines of the first embodiment being illustrated with dashed lines. The second embodiment is similar to the first embodiment shown in FIG. 1 with the exception that a geometric plane defined by the tines 22 does not lie perpendicular to the handle direction. The handle direction points from a mid-point of the handle tab A to a mid-point between the member ends B. The tines 22 point in a forward direction. An advantage is that this embodiment may be more comfortable for a user to use than an embodiment where the tines 22 are perpendicular to the handle direction. It is understood that the tines 22 may also extend in a backward direction.

Figure 3:
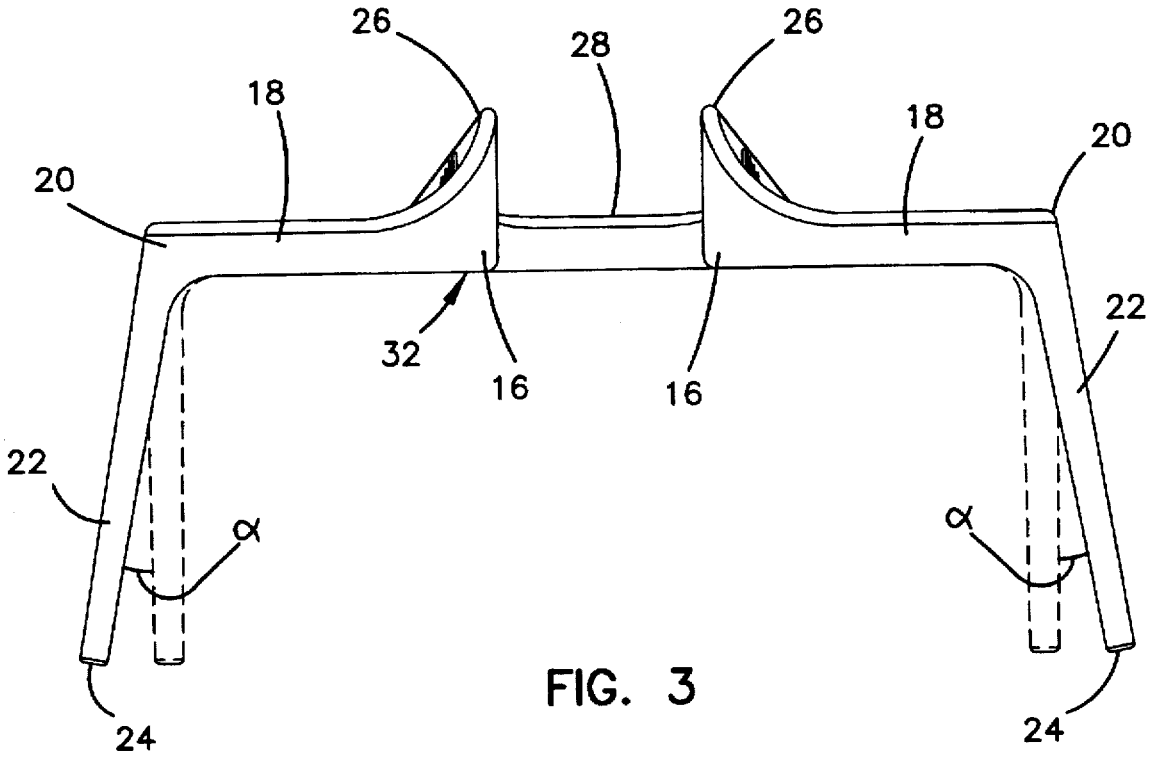
FIG. 3 is an elevation view of a third embodiment of the paper handling device.

The tines 22 may also be oriented so that they do not extend parallel to each other, but extend at a small angle from the parallel condition. FIG. 3 illustrates a third embodiment of the invention where the tines 22 each extend at an angle α (alpha) outwards from each other, so that the tine tips 24 are separated by a greater distance than the arm ends 20. The tines of the first embodiment are illustrated with dashed lines for comparison. This embodiment is advantageous for maintaining a stack of many paper sheets on the device 10, where the outward pressure of the tines 22 may be less effective at maintaining the paper sheets on a pair of parallel tines 22 than with a smaller number of paper sheets. It is understood that the angle α should not be so large that the tines 22 cannot be inserted into a large stack of paper sheets, and that an upper limit of α may be estimated knowing the diameter of the tines 22, the diameter of the pre-punched holes, and the maximum height of a paper sheet stack which is to be held by the device 10.

Figure 4:
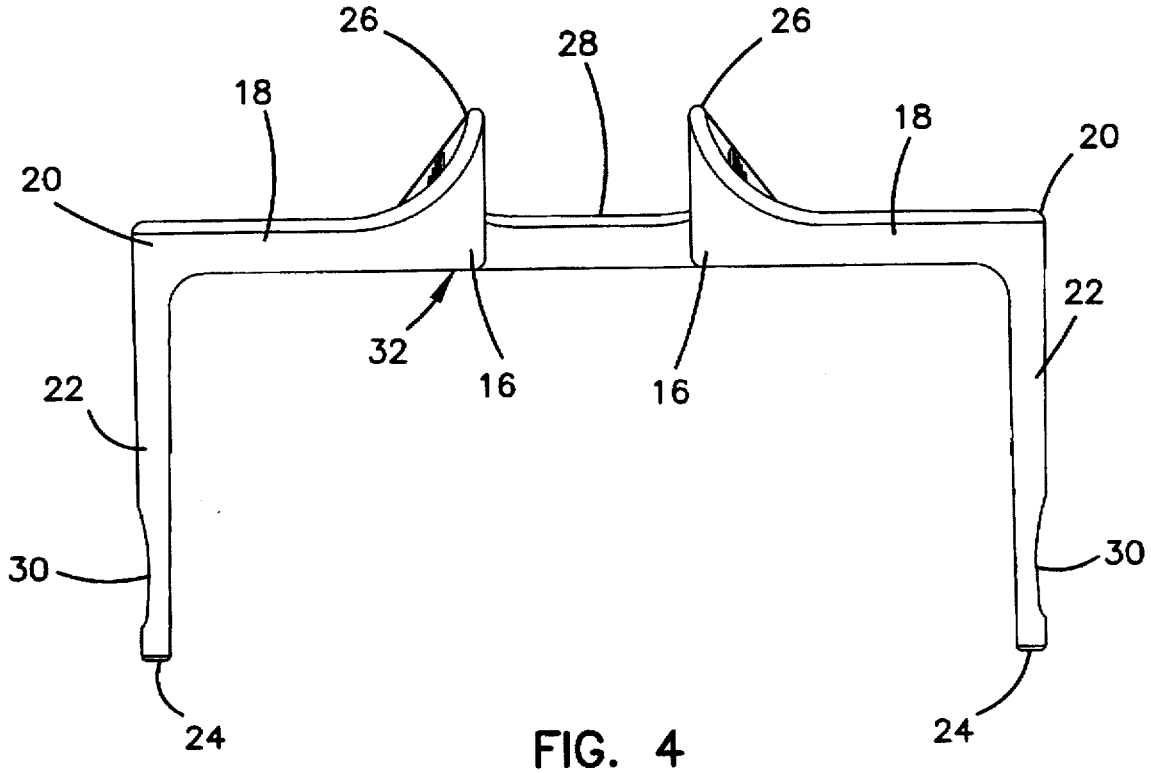
FIG. 4 is an elevation view of a fourth embodiment of the paper handling device.

In a fourth embodiment, illustrated in FIG. 4, notches 30 are provided on the outer sides of the tines 22, near to the tips 24. The notches 30 are preferably shaped so as to support the bottom sheet of a stack of paper sheets loaded on the device 10, and prevent paper sheets from falling off the device 10 even when a large number of sheets is loaded. It is understood that the notches 30 are not made to be so deep as to have an adverse effect on the structural strength of the tines 22. It is also understood that the notches 30 may take a variety of profiles, such as the curved notch illustrated or a flat-bottomed notch. The profile chosen is a matter of engineering design, and is predicated on such factors as the dimensions of the device 10 and the material used to make the device 10.

Figure 5:
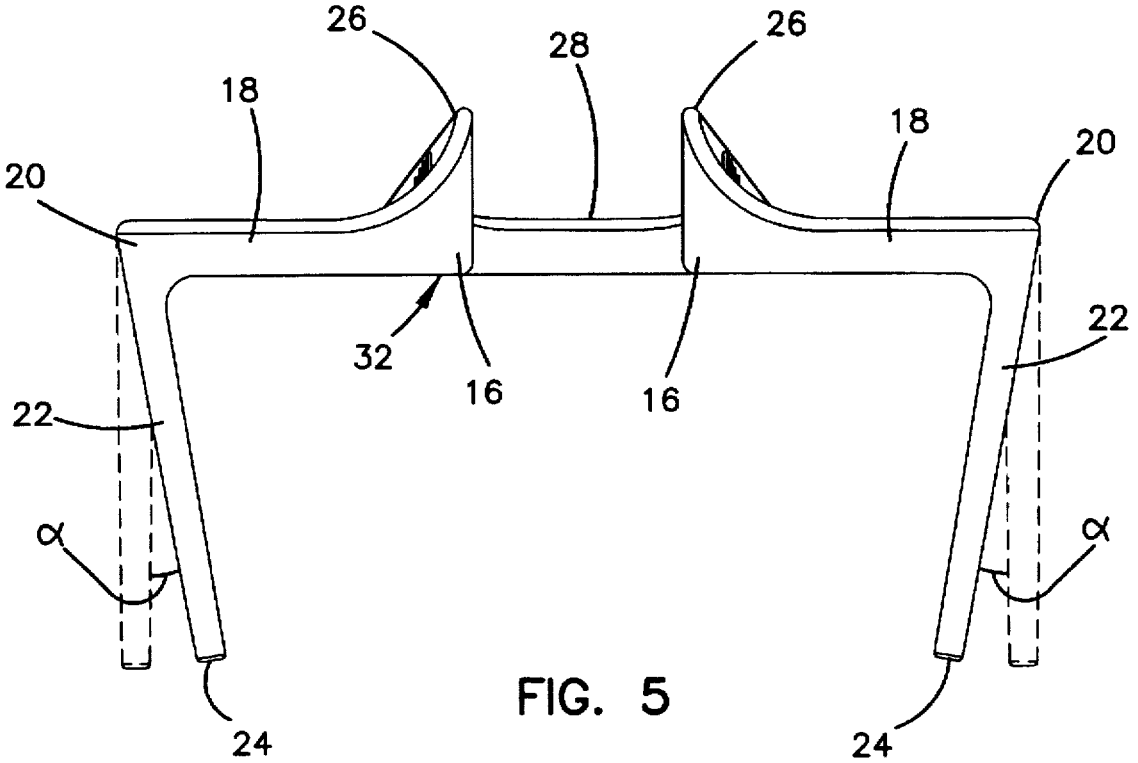
FIG. 5 is an elevation view of a fifth embodiment of the paper handling device.
Figure 6:
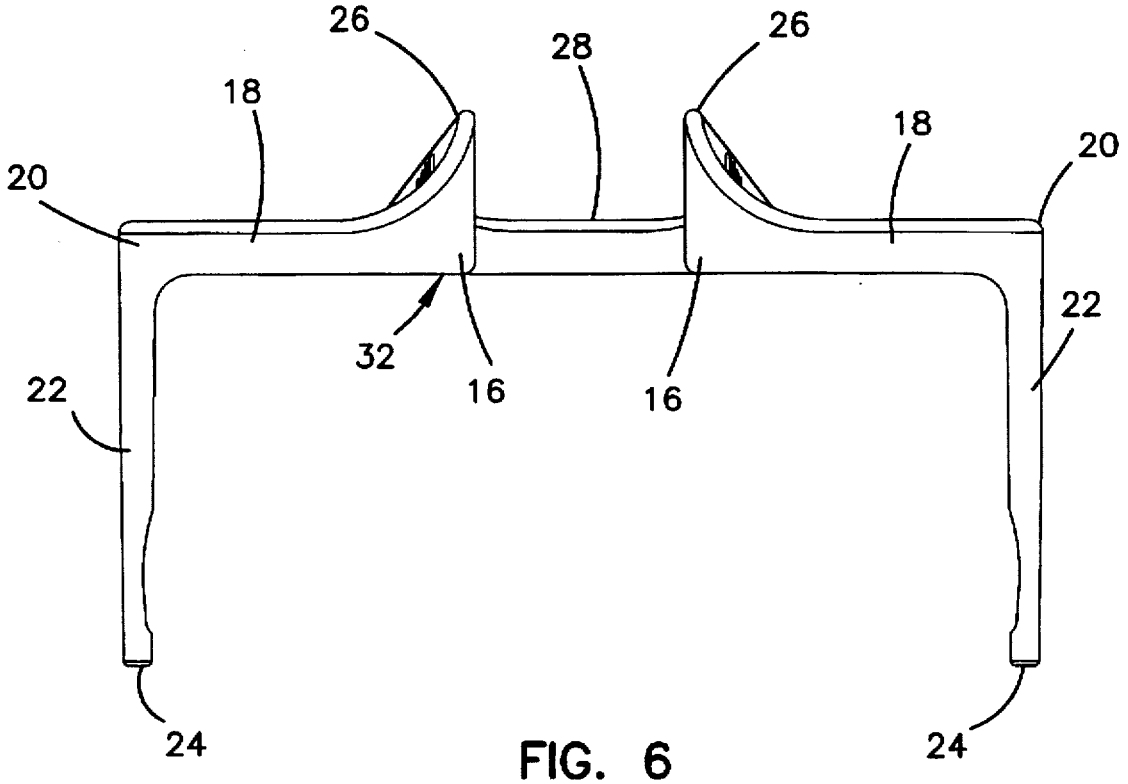
FIG. 6 is an elevation view of a sixth embodiment of the paper handling device.

It is understood that squeezing pressure may be maintained on the paper handling device 10 when handling a stack of paper sheets, rather than releasing the device 10 as discussed above. Thus, if squeezing pressure is maintained or, alternatively, if the spacing between the tines 22 is less than the separation of the pre-punched holes in the paper sheets, then the pressure on the pre-punched holes acts inwards, pushing the holes together. When the pressure acts inwards, the device 10 may preferably have the embodiment illustrated in FIG. 5 where the tines 22 extend inwards from the arm ends 20, in order to produce a force which advantageously maintains a larger number of paper sheets on the device 10. Similarly, the device 10 may have the embodiment illustrated in FIG. 6, where notches 30 are preferably located on the inner surfaces of the tines 22, rather than on the outer surfaces, in order to maintain a larger number of sheets on the device 10.

The bottom surface 32 of the handle portion 12 is preferably flat so that, if the tines 22 are completely inserted into a stack of paper sheets, then the device 10 can rest with its bottom surface 32 lying top of the stack of papers.

Since the tines 22 extend in a direction which is not parallel to the handle portion 12, the paper handling device 10 may be comfortably held between a thumb and forefinger. This feature avoids the need to twist the hand into an awkward orientation in order to insert the device 10 into a stack of paper sheets. Additionally, the side members 14 are preferably provided with finger grip portions 26 which are typically grasped between a thumb and either a forefinger or a forefinger and one or more fingers. The handle portion 12 is preferably provided with a handle tab 28 so that the handle portion 12 may be gripped or held by a finger in order to hold the device 10 more securely and comfortably.

Figure 7:
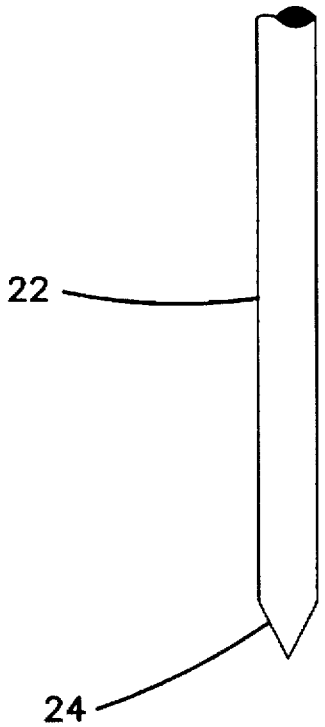
FIG. 7 is a view of a of a tine having a pointed tip.
Figure 8:
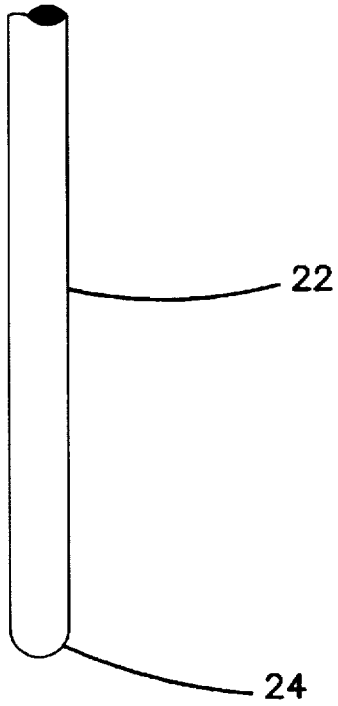
FIG. 8 is a view of a tine having a rounded tip.
Figure 9:
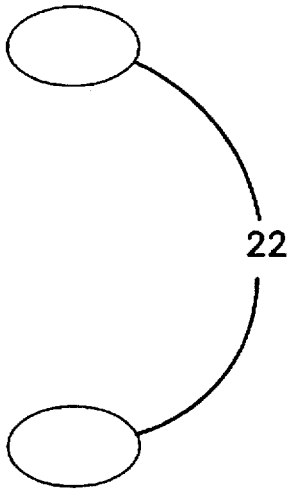
FIG. 9 is a cross-sectional view seen along plane 9—9' showing tines having elliptical cross-sections.

The tines 22 may be provided with an advantageous shape so as to increase the ease with which the tines 22 may be inserted into the pre-punched holes in the paper sheets. For example, each tine 22 may be provided with a tip 24 which is sharply tapered, as illustrated in FIG. 7, or the tip 24 may be rounded, as illustrated in FIG. 8. In addition, the cross-sectional shape of each tine 22 may be designed so as to make it easier to insert the tines 22 into the pre-punched holes. For instance, the tines 22 may have an elliptical cross-section, as illustrated in FIG. 9. In this embodiment, the major axis of the ellipse preferably lies in a direction parallel with the direction of the handle portion 12, i.e. a direction perpendicular to an imaginary line drawn between the tines 22. The effect of reducing the diameter of the tine 22 in the preferred direction is to make it easier for the user to fit the tines 22 past the legs of the paper fastener and into the pre-punched holes of the paper sheets.

Figure 10:
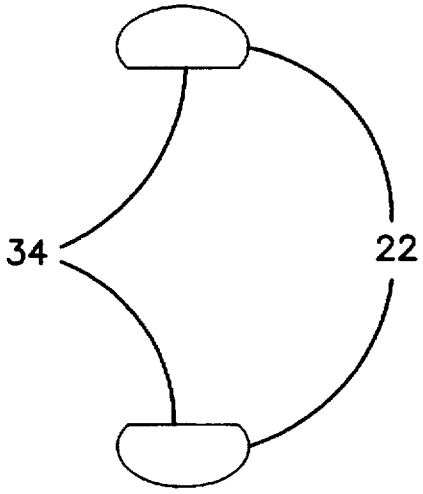
FIG. 10 is a cross-sectional view seen along plane 10—10' showing tines having truncated elliptical cross-sections.

FIG. 10 illustrates an alternative tine cross-section, having a truncated elliptical shape. The truncated elliptical cross-section is mostly elliptical but has a flat inner surface 34. The flat inner surfaces 34 of each tine 22 face each other so as to complement the flat legs of the paper fastener protruding from the pre-punched holes in a stack of paper sheets. This design facilitates the insertion of the device 10 into the pre-punched holes.

Figure 11:
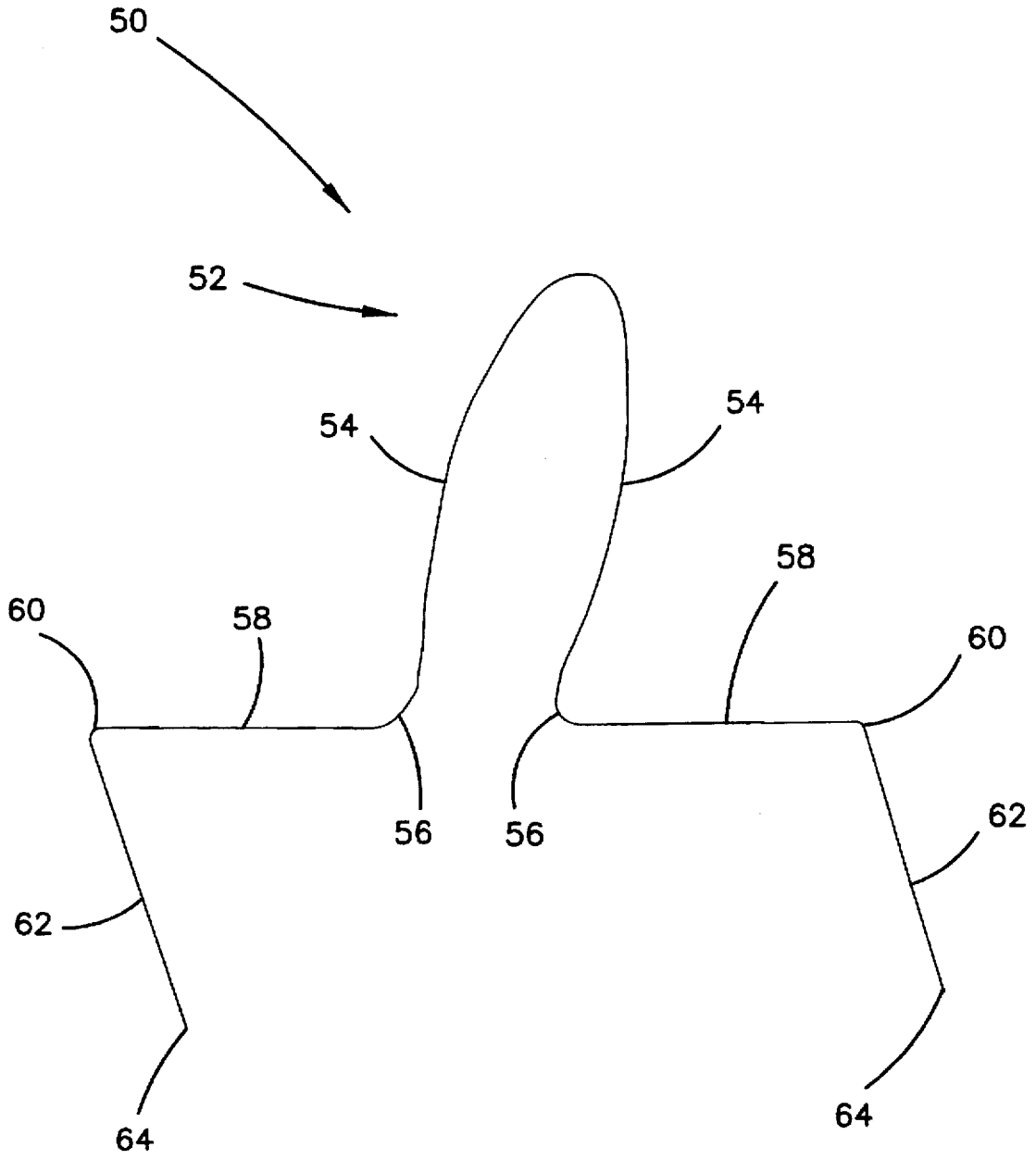
FIG. 11 is a perspective view of the paper handling device formed from a metal rod.

It is understood that at least the handle portion 12 of the device 10 should be formed from a resilient material, such as plastic or metal, so that the handle portion 12 can spring back to its uncompressed state after it has been compressed. Preferably the whole device 10 is made from the same material as the handle portion 12, so as to simplify the manufacturing process and thus reduce manufacturing costs. For example, the device 10 may be made from injection-molded plastic or, alternatively, may be formed from a single metal rod which is bent to assume the appropriate shape, shown generally as 50 in FIG. 11. The device 50 comprises a handle portion 52, first and second side members 54 terminating at first and second member ends 56, first and second arms 58 terminating at first and second arm ends 60, and first and second tines 62 depending from the first and second arm ends 60.

Figure 12:
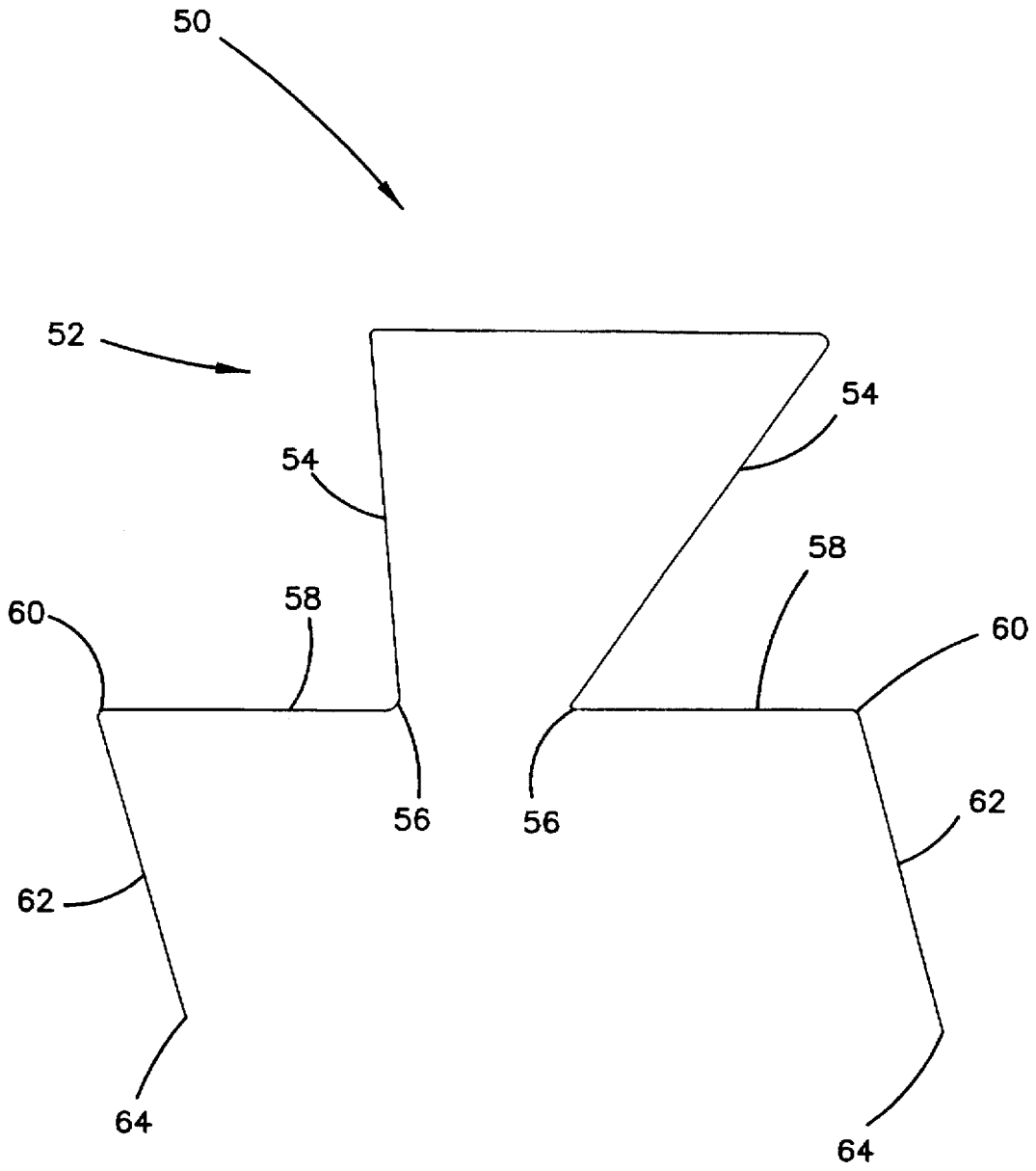
FIG. 12 is a perspective view of a second embodiment of the paper handling device formed from a metal rod.

The handle portions 12 and 52 have been described to be U-shaped with side members 14 and 54 respectively which are close to being parallel, i.e. there is a only a small angle between the side members 14 and 54. FIG. 12 illustrates another embodiment of the paper handling device 50 where the angle between side members 54 is substantially larger than that shown in FIGS. 1 and 11. The device 50 shown in FIG. 12 maintains the same function of the paper handling device 10. Thus, the invention is not limited to a device having a U-shaped handle portion 52 with parallel side members.

This concludes the description of the preferred embodiments of the invention. The following paragraph describes some alternative methods of accomplishing the same objects. The arms 18 are illustrated to be directed approximately 180° from each other. It is understood that the angle between the arms 18 may be considerably less than 180°, for example 30° or less, while still maintaining the function of the paper handling device 10 and 50. It is also understood that the uncompressed separation between the tines 22 could be smaller than the standard separation of the pre-punched holes, so that the device 10 would require stretching so as to fit the pre-punched holes in the paper sheets, rather than compressing as has been discussed above. With the tine 22 separation being smaller than the hole separation, the device 10 would be under tension when loaded with paper sheets and would tend to squeeze the paper between the tines 22. If notches 30 were present, the notches 30 would require to be placed on the inside surfaces of the tines 22, rather than the outside surfaces as shown in FIG. 4.

In summary, a paper handling device has been described which is easily and securely held, and which enables a user to hold a number of paper sheets without losing alignment of pre-punched holes in each sheet. Since the tines 22 exert an outward force on the pre-punched holes of the paper sheets loaded on the device, the paper sheets are held securely in place and are prevented from falling off the device.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A paper handling device which handles paper having a pair of pre-punched holes spaced apart by a hole spacing, the device comprising:

a flexible, substantially U-shaped handle portion having first and second side members, the first and second side members terminating at first and second member ends respectively;

first and second arms respectfully disposed at the first and second member ends and each extending substantially away from the handle portion;

first and second tines depending from the first and second arms respectively.

2. The device of claim 1, wherein the first and second tines extend in a generally parallel direction.

3. The device of claim 1, wherein the first and second tines are normally spaced apart from each other by a distance greater than the hole spacing so that compressing the handle portion reduces the distance between the first and second tines for insertion into respective pre-punched holes in the paper.

4. The device of claim 1, wherein the first and second tines are normally spaced apart from each other by a distance less than the hole spacing so that stretching the handle portion increases the distance between the first and second tines for insertion into respective pre-punched holes in the paper.

5. The device of claim 1, wherein the tines are normally spaced apart by a separation equal to the hole spacing.

6. The device of claim 1, further comprising first and second finger grips respectively disposed on the first and second side members.

7. The device of claim 1, wherein the handle portion defines a handle direction and the first and second tines lie substantially non-parallel to the handle direction.

8. The device of claim 1, wherein the handle portion defines a handle direction and the first and second tines lie substantially transverse to the handle direction.

9. The device of claim 1, wherein a separation between top portions of the first and second tines adjacent respective first and second arms is smaller than a separation between first and second tine tips.

10. The device of claim 1, wherein the first and second tines are provided with notches on respective outer surfaces so as to prevent paper sheets from falling off the paper handling device.

11. The device of claim 1, wherein the first and second tines are provided with notches on respective inner surfaces so as to prevent paper sheets from falling off the paper handling device.

12. The device of claim 1, wherein the first and second tines each have a cross-section perpendicular to respective first and second tine directions and the tine cross-sections are each in the shape of an ellipse.

13. The device of claim 12, wherein the tine cross-sections are each in the shape of a truncated ellipse, with the first and second tines having opposing flat faces.

14. The device of claim 1, wherein tips of the first and second tines are tapered so as to ease entry of the first and second tines into respective holes in the paper.

15. The device of claim 1, wherein tips of the first and second tines are rounded so as to ease entry of the first and second tines into respective holes in the paper.

16. The device of claim 1, wherein the handle portion, the first and second side members, the first and second arms and the first and second tines are formed as a single integrated unit.

17. The device of claim 1, wherein the handle portion, the first and second side members, the first and second arms and the first and second tines are formed from a single rod.

18. The device of claim 1, wherein the handle portion, the first and second side members, the first and second arms and the first and second tines are formed as a single molded device.

19. The device of claim 1, wherein the handle portion has a substantially flat bottom surface.

20. A paper handling device which handles paper having a pair of pre-punched holes spaced apart by a hole spacing, the device comprising:

a flexible handle having first and second side members in an adjustable relation to each other, the first and second side members terminating at first and second member ends respectively, the handle portion defining a handle direction;

first and second arms respectively disposed at the first and second member ends and each extending from the handle portion; and first and second tines depending from the first and second arms respectively, the first and second tines each directed nonparallel to the handle direction;

wherein application of finger pressure to the first and second side members changes a separation between the first and second tines.

21. The device of claim 20, wherein the first and second tines are normally spaced apart from each other by a distance greater than the hole spacing so that compressing the handle portion reduces the distance between the first and second tines, thereby allowing insertion of the first and second tines to be inserted into respective pre-punched holes in the paper.

22. The device of claim 20, wherein the first and second tines are normally spaced apart from each other by a distance less than the hole spacing so that stretching the handle portion increases the distance between the first and second tines, thereby allowing insertion of the first and second tines into respective pre-punched holes in the paper.

* * * * *